United States Patent [19]

Panetti

[11] Patent Number: 4,843,765

[45] Date of Patent: Jul. 4, 1989

[54] RAILWAY TRACK MAINTENANCE MACHINE FOR TRUING THE HEAD OF RAILWAY TRACK RAILS

[76] Inventor: Romolo Panetti, 24, Parc Chateau-Banquet, 1211 Geneva 21, Switzerland

[21] Appl. No.: 214,686

[22] Filed: Dec. 9, 1980

[30] Foreign Application Priority Data

Jan. 9, 1980 [CH] Switzerland ..... 123/80

[51] Int. Cl.[4] ..... E01B 31/17

[52] U.S. Cl. ..... 51/178

[58] Field of Search ..... 51/178; 409/296, 211, 409/213, 216, 217

[56] References Cited

U.S. PATENT DOCUMENTS

| | | | |
|---|---|---|---|
| 3,358,406 | 12/1967 | Speno, Jr. et al. | 51/178 |
| 3,707,808 | 1/1973 | Danko | 51/178 |
| 3,945,152 | 3/1976 | Helgemeir | 51/178 |
| 4,115,857 | 9/1978 | Panetti | 51/178 |
| 4,178,724 | 12/1979 | Bruno | 51/178 |

FOREIGN PATENT DOCUMENTS

| | | |
|---|---|---|
| 404751 | 4/1969 | Australia . |
| 3296178 | 10/1981 | Australia . |
| 15231 | 1/1954 | Fed. Rep. of Germany . |
| 1658355 | 3/1967 | Fed. Rep. of Germany . |
| 2381132 | 9/1978 | France . |

*Primary Examiner*—Roscoe V. Parker

[57] ABSTRACT

Machine provided with two grinding slipper 8 for each rail track 1 connected by a lifting jack 9, and driving beams 10, to its rolling frame 2. On each slipper 8 are mounted four grinding units 6 angularly displaced at an angle $D_1$ with respect to each other. The slippers 8 are located in front of one another in the transverse direction of the track and are hinged on a connecting element 12 in order to be inclined at an angle $D_2$ by means of a double-acting jack 14. The inclination $D_2$ of each slipper is monitored by a potentiometer 27 connected to an indicating dial 28. This machine enables truing of the rail by grinding the whole profile of the rolling surface of the rails by varying the inclination of the grinding slippers at each pass.

3 Claims, 1 Drawing Sheet

RAILWAY TRACK MAINTENANCE MACHINE FOR TRUING THE HEAD OF RAILWAY TRACK RAILS

The present invention concerns a railway track maintenance machine for truing the head of railway track rails.

In known machines of this kind, truing units composed, for example, of a grinding wheel and of its driving motor, are mounted in groups of three or four on slippers located parallel to and above the rails. These slippers are connected to the rolling frame of these machines by means of vertical and longitudinal linkage members having as their respective functions to raise and lower the slippers, causing them to contact or cease to contact the rails and to drive the slippers and guide them along the track as the machine advances.

In the slippers of machines of this type, the truing units are either all mounted at the same angle in a plane transverse to the track thus all truing the same sideline of the profile of the surface of the head of the rail or each inclined with respect to the other at a slight angle in the said plane in order each to true a sideline slightly spaced apart from the adjacent sideline. In this latter case, the difference in orientation of the truing unit has to be slight in order to obtain good results and to reduce to a minimum the width of the chamfers resulting from the truing.

However, due to the limited number of slippers which can be mounted on a machine of this type, their length being of an average of two meters, it is not possible in these two types of mounting to true the whole profile of the head of the rails. To insure this effect, the units can, however, be mounted inclined the one with respect to the other at a greater angle, sufficient for the entire profile to be trued with the total number of slippers available.

However, the resultant truing is irregular and the chamfers machined are too wide and do not connect sufficiently to restore the profile of the head of the rails.

On larger truing trains, known and used on the major lines, this is not a problem because they have sufficient cars on which to install the necessary number of slippers to ensure simultaneously the quality of the work and the total reconstitution of the correct profile of the head of the rails. On the other hand these trains need many workers, are very expensive to buy and to maintain, and are cumbersome and difficult to transfer from one railway system to another.

Recent practice favors the use of compact machines on the major lines since they need less investment and less maintenance, fewer personnel and can be very easily transferred.

The problems arising due to the low number of truing slippers that can be installed on these machines, described hereabove, have thus a great importance and have to be solved so that these machines can operate not only on the major lines but also on others as well.

The object of the invention is to solve this problem.

The proposed solution consists of mounting on these machines tool carrier slippers having a variable inclination in a transverse plane with respect to the track, in order to enable a staggered array of the whole of the truing units mounted on each slipper around the profile of the surface of the head of the rails, as will be later seen in a detailed manner. This solution eliminates the problem of an insufficient number of rectifying units as will be later seen in a detailed manner. This solution eliminates the problem of an insuffient number of rectifying units by having a greater number of working passages at different inclination angles as small as necessary between the rectifying units mounted in each slipper.

The attached drawing shows schematically and by way of example one embodiment of the object of the invention as well as one variant.

Figure 1:
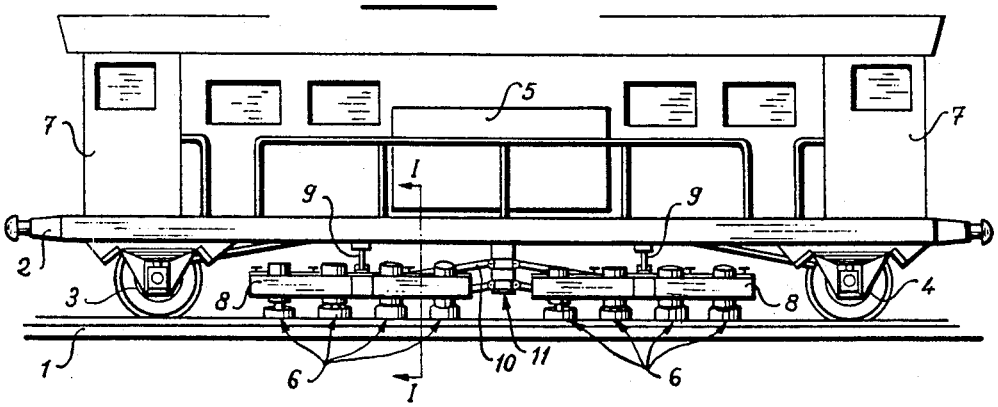
FIG. 1 is a general view in elevation of the apparatus according to the invention.

The machine shown in FIG. 1 is a truing vehicle on the rolling surface of the rails 1 of a railway track on which its rolling frame 2 rests by mean of two axles 3 and 4. This machine, of the compact type, is automotive and is equipped to this effect with a unit 5 furnishing the necessary energy for its truing and for the driving and for the control of its truing units 6, and with two driving cabins 7 in front and in the rear, in which all the control and measuring means are located.

In the example shown, the truing units are grinding units 6, sixteen in number, mounted in groups of four on four slippers 8 located in pairs on each rail track, the one behind the other, between the axles 3 and 4. Each slipper 8, located parallel to and above the rail track 1, is connected to the rolling frame 2 by means of a jack 9 and two beams 10 articulated onto a post 11 fixed under the rolling frame. In the vertical plane, transverse to the track, as seen in the partial cross-section of FIG. 2, the two slippers 8 in front of each other, only the left one of which is represented, are connected by their middle portion to the connecting element 12.

These slippers 8 are angularly displacable in a plane perpendicular to the axis of the rail. In the example shown each slipper is articulated on a pivot 13. A double-acting jack 14 is located between each slipper 8 and the connecting element 12 and is hinged to these two members on two axles 15 and 16 forming with the pivot 13 a deformable triangle.

Each slipper 8 comprises a frame formed of two longitudinal walls 17 connected by crossmembers 18 thus forming chambers within which the grinding units 6 are mounted. These grinding units comprise a cylindrical rotative grinding wheel 60, here a grinding disc working with its front surface, fastened to the end of the shaft of an electric driving motor 19. Each motor 19 is fixed on a frame 20 comprising a slide 21 mounted on a vertical slide 22 fastened to the inside wall 17 of the frame of the slipper 8. A control screw and a hand-wheel 23 permit adjustment of the height of each slide 21 and thus of each grinding wheel 60 with respect to the slipper 8.

The slide 21 of each frame 20 forms with the axis of rotation of the grinding wheel 60 an angle $D_1$ preestablished as the angle desired between the four grinding units thus mounted onto the slipper 8.

The two chambers of the hydraulic double-acting jack 14 are connected to a hydraulic feeding circuit which is not shown, comprising a three way distributor, having double control and spring returns which permit adjustment of the slipper 8 to an angle $D_2$ pre-established and defined later on.

The connecting element 12 is hinged by means of two brackets 24 and 25 to the two beams 10 shown in FIG. 1 and each slipper 8 is connected by the hinge 26 to the jack 9. Thus jack 9 has the function of lifting the slipper 8 and adjusting the resting pressure of the slipper on the rail track 1.

An apparatus for control of the inclination angle $D_2$ of each slipper 8 with respect to the connecting element 12, here the potentiometer 27, is mounted on the pivot 13 and is connected to an indicating dial 28 located in the driving compartments 7 of the machine, to permit the operator to adjust and control the said inclination angle $D_2$.

Figure 4:
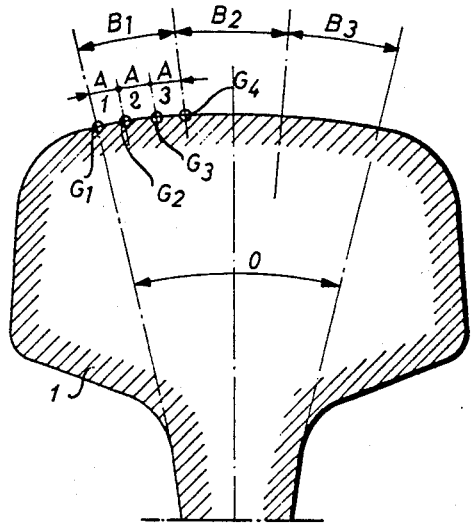
FIG. 4 is a partial cross-section of a rail showing the principle of the invention.

Realized in this way, the machine according to the invention enables to true by grinding the rolling surface of the two railtracks 1 according to a working process shown in FIG. 4 and given as example for the truing of the rolling table of a UIC 60 rail.

On this type of rail, the profile of the rolling table is in the form of a curve constituted by the connecting of a central arc having a great radius located between two arches of lesser radius, the interconnection of which arcs forms an angle to the center O of 25.3 degrees, the subtend of which is of 52 millimeters.

Figure 2:
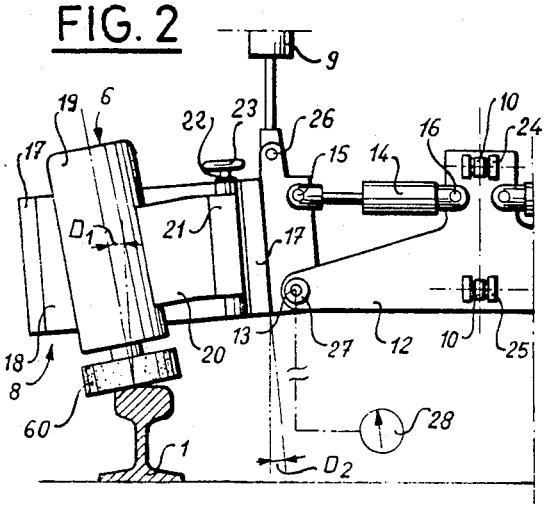
FIG. 2 is a partial cross-section of it at greater scale, taken along the axis 1—1 of FIG. 1.

In this case, the four grinding units 6 are each inclined with respect to the other at a slight angle $A_1$, $A_2$,$A_3$, so as to grind each a side-line $G_1$, $G_2$, $G_3$, $G_4$, these side-lines having a total angle $B_1$ equal for example to one third of the total angle O, which represents an arc length on the order of 17 millimeters. This arc length can be ground at the first pass of the machine in orientating the slipper 8 by means of the jack 14 to an angle $D_2$ (FIG. 2). The result of this first pass will be represented in profile under the shape of an envelope having four chamfers connected to each other and each being 5 to 6 millimeters in width. At the following passes of the machine, one inclines successively the slipper 8 toward the right at an angle $B_2$ and then at an angle $B_3$ and thus the whole rolling table can be ground and its profile restored in the form of an envelope having twelve chamfers of very small width which constitute according to the quality criteria now in use an excellent grinding result.

Of course, according to the severity of the defects to remedy, several passes can be made at the same inclination of the slipper before passing to the next inclination. The two other grinding slippers 8 can either be used in the same manner when only the rolling table has to be trued or be used according to the same principle to grind also the portion of the rail connecting the rolling table to the inside side of each rail track, this portion also being in the form of an arc.

This process, which allows positioning of the grinding unit at different inclinations, very small with respect to the others, on each slipper has the advantage of the obtention of an excellent result in the elimination of undulatory deformations of great wavelength, the four lines $G_1$, $G_2$, $G_3$ and $G_4$ ground by the slipper 8 being very close to each other.

It is also possible to incline the driving unit 6 of a same slipper 8 the one with respect to the others at a greater angle. In such a variant during the first rectifying pass four chamfers of the head of the rail would be ground, these chamfers being not connected the ones to the others but distributed on the whole surface of the profile of the rail head to be ground. Modifying the inclination of the slipper before the second pass will cause chamfers to be ground between the chamfers machined previously. Thus in three passes with offset angles of the slipper, one can also reprofile the rail in twelve chamfers connected the ones to the others.

Figure 3:
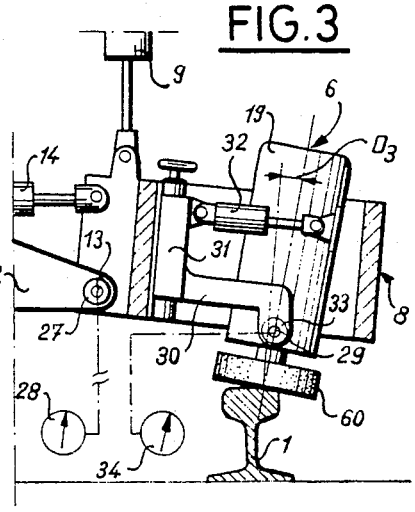
FIG. 3 is a cross-section, similar to FIG. 2, of the variant.

In FIG. 3, the inclination of the grinding unit 6 is adjustable by virtue of the hinged mounting of the motor 19 on a pivot 29 carried by an arm 30 fast with a special slide 31 mounted in the same way and having the same function as the slide 21 of the example shown at FIG. 2 already described. A hydraulic double-acting jack 32 is located between this slide and the motor 19 to control and adjust the inclination $D_3$ of each grinding unit 6 and is connected to this effect to a power circuit, not shown, comprising a distributor of the same type as the one of the feeding circuit of the jack 14. A potentiometer 33 is mounted on the pivot 29 and connected to an indicating dial 34 to survey the inclination of each grinding unit 6 in the same manner as the inclination of the slipper 8 is measured. This variant permits variation of the angular offset $A_1$, $A_2$, $A_3$ (FIG. 4) between the grinding units 6 mounted on the slipper 8 as a function of of the arc of the angle $B_1$, $B_2$, $B_3$ that one desires to grind at each pass. It is thus possible to reduce or to increase the number of grinding passes to true the rolling table of the rail 1 of FIG. 4 according to the required degree of precision.

In another variant, not shown, which may be advantageous for the automation of the successive pivotments of the slipper 8, the feeding circuit of the jack 14 comprises an angular feeding control of the angle $B_1$, $B_2$, $B_3$, of the step-by-step type, controlled by the reversal of the direction of movement of the machine, between each grinding pass. In this case, the control of the distributor of this feeding circuit is linked to a regulation loop in which the indicating apparatus 28 and a display of the value of the chosen angle $B_1$, $B_2$, $B_3$ itself actived by the step by step control, are integrated.

The invention can be used on any type of grinding slipper with the same advantages. Thus for example for reprofiling slippers which are guided on the rails by rollers and in which each grinding unit is mounted movably in height and connected to a jack for the adjustment of the grinding pressure, the control device of their transverse inclination may be realised by pivoting around a shaft carried on an intermediate liftable support equiped with a set of guiding rollers, or by pivoting directly around the said rollers.

Of course, the hinging shaft 13 of the slipper may be replaced by any other equivalent pivoting member such as for example a curved slide or a combination of levers creating a real or virtual axis of articulation.

Finally in a simplified variant, the apparatus checking the inclination of the slipper can consist of simple abutments limiting its stroke.

The embodiments of the invention in which the exclusive property or privilege is claimed are defined as follows:

1. Railway track maintenance machine for truing the head of railway track rails comprising a rolling frame adapted to roll on railway track rails to be trued, at least one tool carrier slipper mounted under the said frame displaceably with respect to the frame vertically and angularly in a plane perpendicular to the length of the rail, said at least one slipper carrying at least two truing units each having a rotary cutting tool, said tools having non-parallel axes of rotation as viewed in said plane; means for raising and lowering the tool carrier slipper relative to the frame which means serves also to press the slipper against the rail at the desired pressure, means for swinging the slipper in said perpendicular plane relative to the rolling frame, means to couple the truing units and the slipper such that each truing unit is individually angularly displaceable and bodily vertically adjustable relative to the slipper in a plane perpendicular to the length of the rail, means for selectively individually swinging each said truing unit in said perpendicular plane relative to the slipper, and means for selectively individually bodily vertically adjusting each said truing unit in said perpendicular plane relative to the slipper.

2. Machine according to claim 1, comprising two tool carrier slippers located on opposite rails of the track, a connecting member to which these slippers are pivotally interconnected, and a double-acting jack which connects each slipper to the connecting member.

3. Machine according to claim 1, wherein the slipper and the truing unit swing about axes that are parallel to each other and to the length of the track.

* * * * *